US010582827B2

(12) United States Patent
Yoo et al.

(10) Patent No.: US 10,582,827 B2
(45) Date of Patent: Mar. 10, 2020

(54) DISHWASHER

(71) Applicant: Samsung Electronics Co., Ltd., Suwon-si (KR)

(72) Inventors: Seung Wan Yoo, Suwon-si (KR); Buesing Johannes, Yongin-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 241 days.

(21) Appl. No.: 15/616,238

(22) Filed: Jun. 7, 2017

(65) Prior Publication Data

US 2017/0354311 A1 Dec. 14, 2017

(30) Foreign Application Priority Data

Jun. 8, 2016 (KR) ..... 10-2016-0071064

(51) Int. Cl.

| | |
|---|---|
| ***A47L 15/42*** | (2006.01) |
| ***A47L 15/23*** | (2006.01) |
| ***A47L 15/16*** | (2006.01) |

(52) U.S. Cl.

CPC ..... *A47L 15/4278* (2013.01); *A47L 15/16* (2013.01); *A47L 15/23* (2013.01); *A47L 15/4214* (2013.01)

(58) Field of Classification Search

None

See application file for complete search history.

(56) References Cited

U.S. PATENT DOCUMENTS

| | | | | |
|---|---|---|---|---|
| 2008/0149148 | A1* | 6/2008 | Woo | A47L 15/4204 134/104.1 |
| 2008/0271759 | A1 | 11/2008 | Burrows et al. | |
| 2014/0216507 | A1* | 8/2014 | Pyo | A47L 15/4223 134/179 |
| 2014/0299683 | A1 | 10/2014 | Zhao et al. | |

FOREIGN PATENT DOCUMENTS

| | | |
|---|---|---|
| DE | 102011081562 | 2/2013 |
| EP | 0443662 | 8/1991 |
| JP | 10-225420 | 8/1998 |
| KR | 10-2012-0126596 | 11/2012 |
| KR | 10-2013-0081113 | 7/2013 |

OTHER PUBLICATIONS

Whirlpool, Rotary Bearing for spraying arm of dishwashing machine, 2001 Espacenet translation (Year: 2001).*

European Communication dated Jul. 9, 2019 in European Patent Application No. 17174954.2.

* cited by examiner

*Primary Examiner* — Cristi J Tate-Sims

(74) *Attorney, Agent, or Firm* — Staas & Halsey LLP

(57) ABSTRACT

The dishwasher includes a cabinet in which a washing space is formed, a supply pipe through which the washing water moves, and a nozzle unit connected to the supply pipe for spraying washing water into the washing space. The nozzle unit includes a unit body having an injection hole for injecting wash water into the washing space, a rotation holder coupled to the unit body, and a rotation holder rotatably disposed on the supply pipe. The supply pipe includes a holder that supports the rotation holder and is coupled along the periphery of the supply pipe.

20 Claims, 7 Drawing Sheets

DISHWASHER

CROSS-REFERENCE TO RELATED APPLICATIONS

This application claims the priority benefit of Korean Patent Application No. 10-2016-0071064, filed on Jun. 8, 2016, in the Korean Intellectual Property Office, the disclosure of which is incorporated herein by reference in its entirety.

BACKGROUND

1. Field

Embodiments of the present disclosure relate to a dishwasher, and more particularly to a dishwasher having improved cleaning efficiency.

2. Description of the Related Art

A dishwasher has a main body with a washing tub inside thereof, a basket for storing dishes, a sump for storing washing water, an injection nozzle for spraying washing water, and a pump for supplying washing water stored in the sump to the injection nozzle. The dishwasher is a household appliance that cleans tableware by spraying high pressure washing water to the tableware.

In general, a rotor type spraying structure with a rotating nozzle unit is applied to the dishwasher. The rotating nozzle unit injects washing water while rotating by water pressure.

The nozzle unit is rotated by the water pressure of the sprayed washing water while the washing water is sprayed to the washing space through the nozzle unit. In this process, if there is a foreign substance in the nozzle unit, or if the flow loss is large due to the gap between the parts of the nozzle unit, the rotational force of the nozzle unit is reduced, and the amount of washing water to be sprayed is also reduced.

As a result, the cleaning efficiency for the tableware placed in the washing space is reduced

SUMMARY

Therefore, it is an aspect of the present disclosure to provide a dishwasher capable of reducing flow loss.

It is another aspect of the present disclosure to provide a dishwasher having an improved assembly structure.

It is still another aspect of the present disclosure to provide a dishwasher with improved spray efficiency.

Additional aspects of the present disclosure will be set forth in part in the description which follows and, in part, will be apparent from the description, or may be learned by practice of the disclosure.

In accordance with an aspect of the present disclosure, a dishwasher includes a cabinet provided with a washing space inside thereof, a supply pipe through which the wash water moves and a nozzle unit connected to the supply pipe for spraying washing water into the washing space. The nozzle unit includes a unit body having an injection hole for injecting washing water into the washing space and a rotation holder coupled to the unit body and rotatably disposed on the supply pipe. The supply pipe includes a holder that supports the rotation holder and is coupled along the periphery of the supply pipe.

The holder may be provided in a ring shape and is fitted to the end of the connection pipe.

The connection pipe may include an annular seating groove formed concavely along the circumference. The holder may include a seating projection having an outer diameter larger than that of the connection pipe, and configured to be inserted into the seating groove.

The connection pipe may include an annular seating projection which is convexly formed along the circumference. The holder may include a seating groove having an outer diameter larger than that of the connection pipe, and having an inner surface on which the seating projection is inserted.

The holder may include a material having a coefficient of friction smaller than that of the connection pipe.

The supply pipe may further include a support portion formed along the periphery of the supply pipe and spaced apart from the holder to form a mounting space in which the rotation holder is disposed between the holder and the support pipe.

The rotation holder may include a rotation holder body rotatably disposed outside the supply pipe and a mounting projection protruding from an outer circumferential surface of the rotation holder body. The unit body may include an opening forming portion for forming an opening through which the wash water supplied from the supply pipe flows and a plurality of ribs protruding from the opening forming portion and fitted with the mounting projection so that the unit body is mounted on the rotation holder.

The plurality of ribs may include mounting ribs supporting the mounting projection and restricting movement of the mounting projection.

The plurality of ribs may include a plurality of support ribs forming an insertion space into which the mounting projection is inserted and a plurality of connection ribs connecting the plurality of support ribs and the plurality of mounting ribs.

The plurality of mounting ribs and the plurality of support ribs may be alternately arranged in the circumferential direction while being spaced apart in the rotation axis direction of the rotation holder.

One end of the plurality of mounting ribs and the other end of the plurality of support ribs are separated from each other to allow the mounting projections to be moved. The plurality of connection ribs connect the other end of the plurality of mounting ribs and one end of the plurality of support ribs.

The rotation holder may further include at least one spaced projection provided on an inner circumferential surface of the rotation holder body and configured to protrude to be separated from the connection pipe.

The unit body may include an inlet guide portion protruding from the inside of the unit body, and having at least a portion inserted into an end portion of the connection pipe.

The unit body may include an upper body having a first coupling rib and a second coupling rib forming an insertion groove between the first coupling rib and the second coupling rib and disposed outside the first coupling rib and a lower body having a third coupling rib inserted into the insertion groove and forming an inner space between the upper body and the lower body. The lower body, the inlet guide portion and the third coupling rib are integrally formed.

In accordance with another aspect of the present disclosure, a dishwasher includes a cabinet provided with a washing space inside thereof, a supply pipe forming a connection portion and through which the wash water moves and a nozzle unit connected to the connection portion for spraying washing water into the washing space. The nozzle unit may include a unit body having an opening forming part for forming an opening through which the washing water moving from the supply pipe flows and a plurality of ribs formed at the opening forming portion and spraying washing water into the washing space and a rotation holder having a mounting projection configured to be mountable to the plurality of ribs and rotatable about the connection portion.

The plurality of ribs may include a plurality of mounting ribs to which the mounting projection is mounted and restricting movement of the mounting projection.

The plurality of ribs may include a plurality of support ribs forming an inserting space for inserting the mounting projection and spaced apart from each other in the rotation axis direction of the rotation holder and arranged alternately in the circumferential direction with the plurality of mounting ribs and a plurality of connection ribs connecting the plurality of support ribs and the plurality of mounting ribs.

One end of the plurality of mounting ribs and the other end of the plurality of support ribs may be spaced apart from each other. The plurality of connection ribs may connect the other end of the plurality of mounting ribs and one end of the plurality of support ribs.

The rotation holder may include a rotation holder body formed with the mounting projection and positioned between the inner end of the plurality of ribs and the supply pipe.

In accordance with another aspect of the present disclosure, a dishwasher includes a cabinet provided with a washing space, a supply pipe forming a connection portion and supplying the wash water and a nozzle unit rotatably connected to the connection portion to spray washing water into the washing space. The connection portion may include a connection pipe extending from the supply pipe and a holder having an outer diameter larger than an outer diameter of the connection pipe and fitted to the end of the connection pipe. The nozzle unit may include a rotation holder rotatably disposed on the connection pipe and configured to be restricted in movement in the rotation axis direction by the holder and a unit body having an injection hole formed for spraying wash water in the washing space, and detachably coupled to the rotation holder to rotate together with the rotation holder.

BRIEF DESCRIPTION OF THE DRAWINGS

These and/or other aspects and advantages will become apparent and more readily appreciated from the following description of the embodiments, taken in conjunction with the accompanying drawings of which.

DETAILED DESCRIPTION

Figure 1:
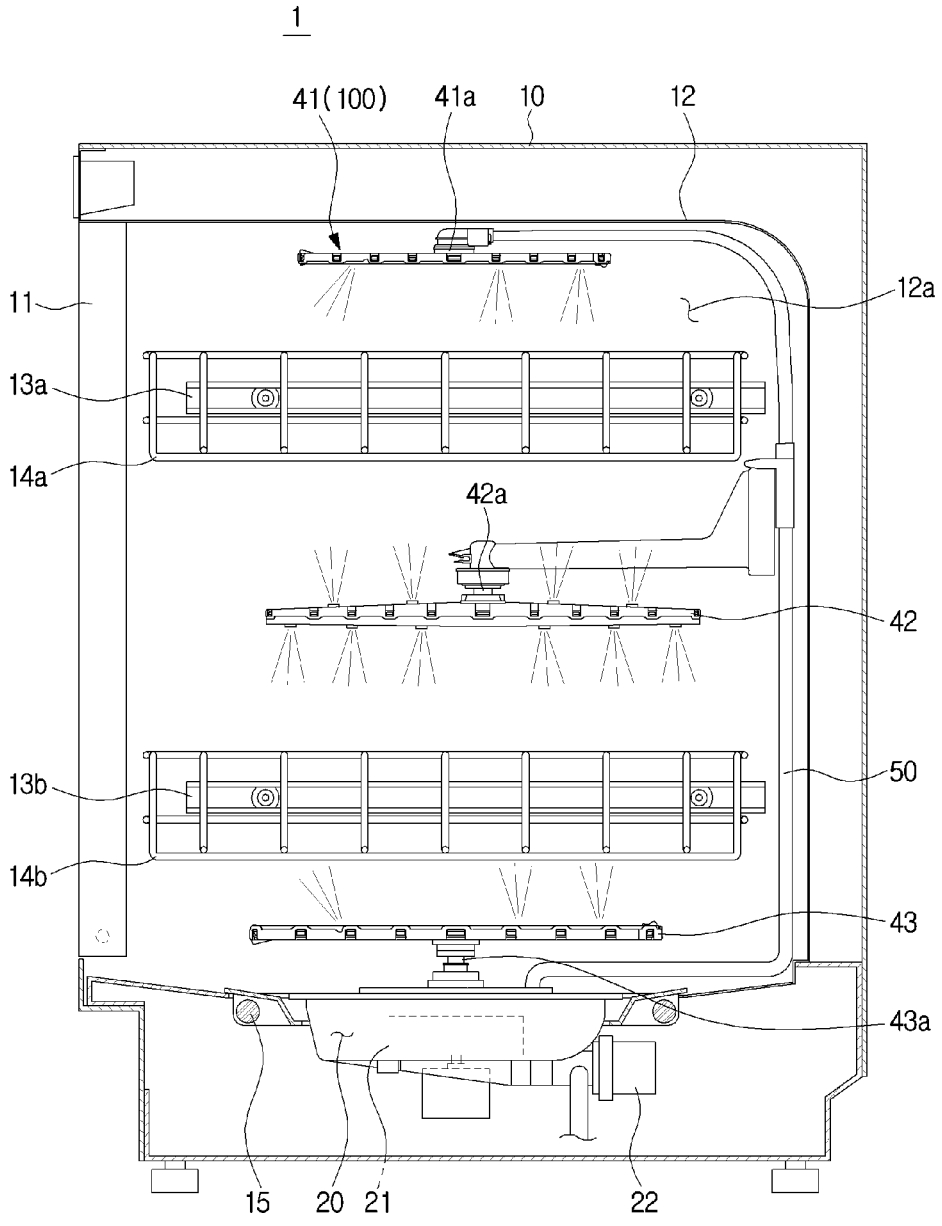
FIG. 1 is a view of a dishwasher according to an embodiment of the present disclosure.

The embodiments described in this specification and configurations illustrated in drawings are only exemplary embodiments and do not represent the overall technological scope of the disclosure, and it is to be understood that the disclosure covers various equivalents, modifications, and substitutions at the time of filing of this application.

Also, throughout the entire specification, the same reference numerals refer to the same components or elements to serve the same function.

Also, the terminology used herein is for the purpose of describing particular embodiments only and is not intended to be limiting of the present disclosure. Also, as used herein, the singular forms "a," "an," and "the," are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Also, it will be understood that, although the terms including ordinal numbers such as "first," "second," etc. may be used herein to describe various elements, these elements are not limited by these terms. These terms are only used to distinguish one element from another. For example, a second element could be termed a first element without departing from the teachings of the present disclosure, and similarly a first element could be also termed a second element. The term "and/or" includes any and all combinations of one or more of the associated, listed items. Hereinafter, embodiments according to the present disclosure will be described in detail with reference to the accompanying drawings.

Hereinafter, embodiments according to the present disclosure will be described in detail with reference to the accompanying drawings.

A dishwasher 1 includes a cabinet 10 forming an outer appearance, a washing tub 12 provided inside the cabinet 10, a dish basket 14*a*, and 14*b*, a sump 20 for collecting and storing wash water, and an injection unit 41, 42, and 43 for spraying wash water.

The washing tub 12 is provided in a substantially box shape and has a front face opened to allow the dishware to be put in and out. The open front of the washing tub 12 may be opened and closed by a door 11. The door 11 may be rotatably coupled to the cabinet 10. Washing water is injected into the washing tub 12 to form a washing space 12*a* in which the dishes can be washed.

The dish baskets 14*a* and 14*b* may include an upper dish basket 14*a* and a lower dish basket 14*b*. The upper dish basket 14*a* may be supported by an upper rack 13*a* and the lower dish basket 14*b* may be supported by a lower rack 13*b*. The upper rack 13*a* and the lower rack 13*b* may be slidable forward and backward in the washing tub 12.

The sump 20 may be provided with a washing pump 21 for pumping the stored water to the injection unit 41, 42, and 43. The washing water pumped by the washing pump 21 may be supplied to the first to third injection units 41, 42 and 43 through a supply pipe 50.

In addition, a heater 15 for heating the washing water and a drainage pump 22 for draining the washing water may be provided under the washing tub 12.

Meanwhile, as shown in FIG. 1, the first injection unit 41 may be provided above the upper dish basket 14*a*. The second injection unit 42 may be provided between the upper dish basket 14*a* and the lower dish basket 14*b*. The third injection unit 43 may be provided under the lower dish basket 14*b*.

The first injection unit 41 may rotate about a rotation axis 41*a* and the second injection unit 42 may rotate around a rotation axis 42*a*. The third injection unit 43 may be provided to rotate around a rotation axis 43*a*.

The first injection unit 41 may spray the washing water toward the tableware stored in the upper dish basket 14*a* and the second injection unit 42 may spray the washing water toward the tableware stored in the upper dish basket 14*a* and the lower dish basket 14*b*. The washing water may be sprayed toward the tableware. In addition, the third injection unit 43 may spray the washing water toward the tableware accommodated in the lower dish basket 14*b*.

Figure 2:
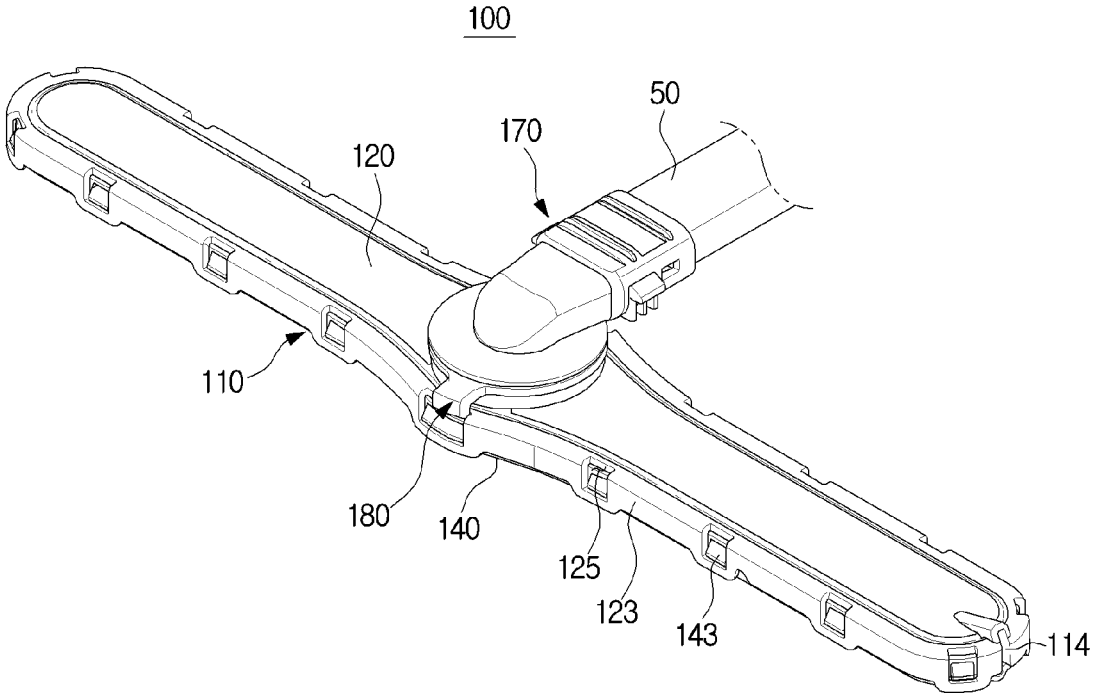
FIG. 2 is a perspective view of a nozzle unit of a dishwasher according to an embodiment of the present disclosure.
Figure 3:
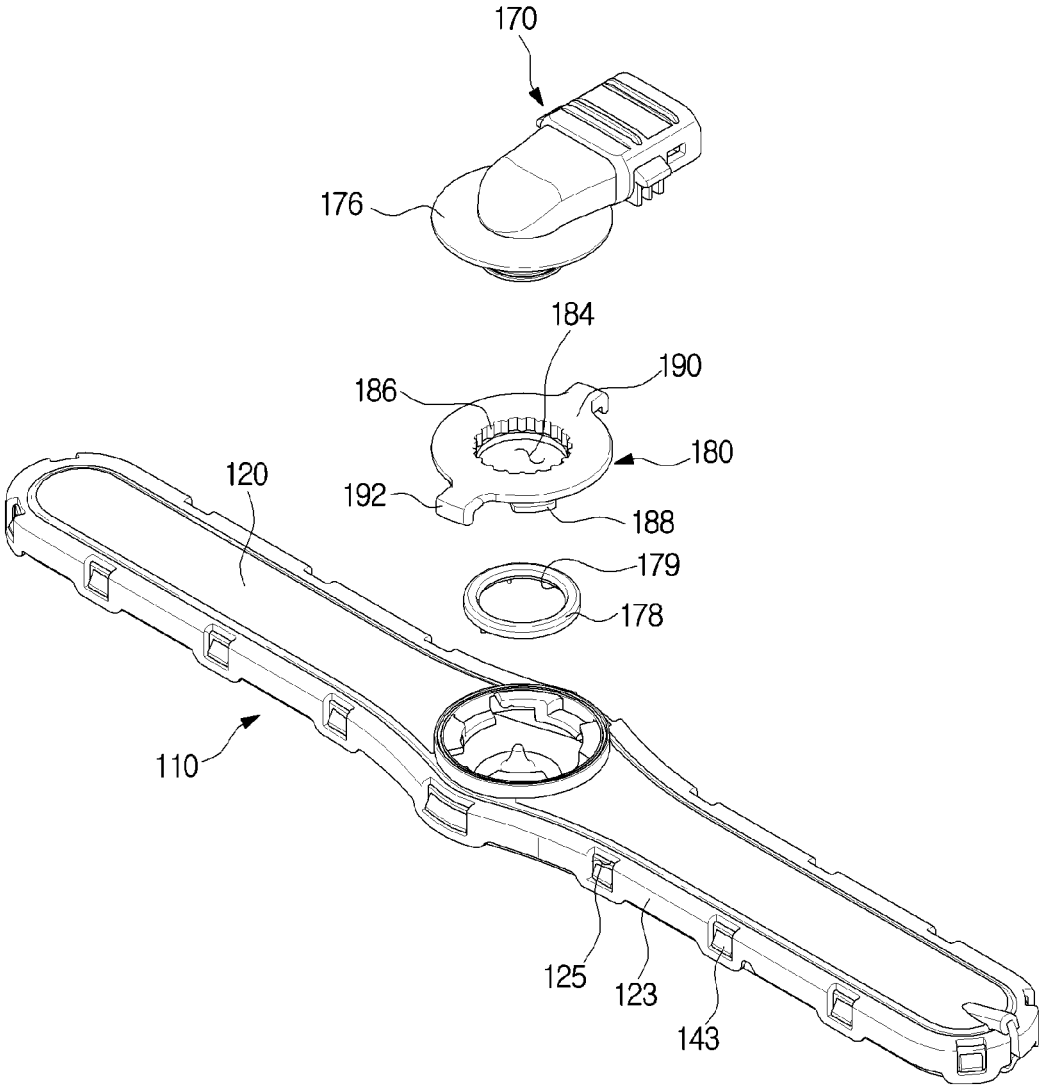
FIG. 3 is an exploded perspective view of the nozzle unit of the dishwasher according to an embodiment of the present disclosure.
Figure 4:
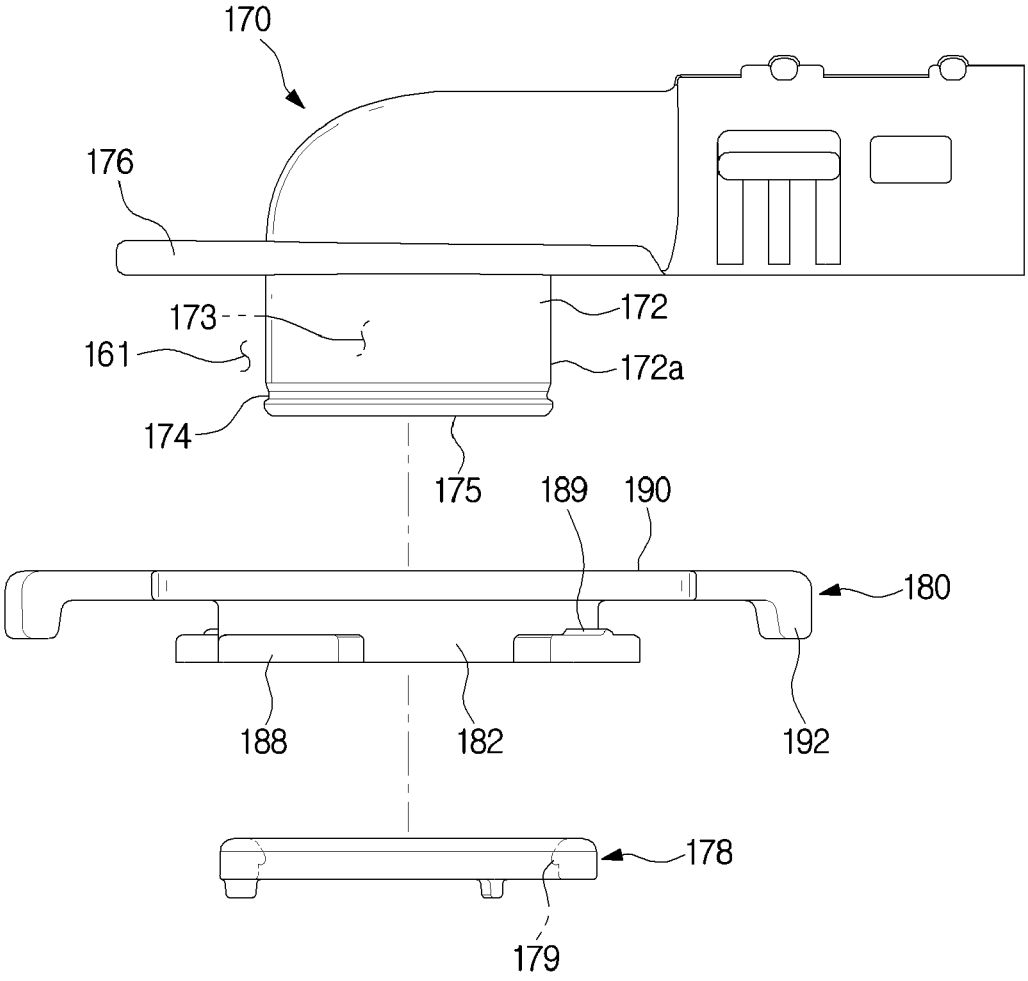
FIG. 4 is a side view of a part of the nozzle unit of the dishwasher according to an embodiment of the present disclosure.

FIG. 2 is a perspective view of a nozzle unit of a dishwasher according to an embodiment of the present disclosure. FIG. 3 is an exploded perspective view of the nozzle unit of the dishwasher according to an embodiment of the present disclosure. FIG. 4 is a side view of a part of the nozzle unit of the dishwasher according to an embodiment of the present disclosure.

A nozzle unit 100 is configured to spray wash water into the washing space 12*a* in the washing tub 12. The nozzle unit 100 is the first injection unit 41 among the first to third injection units 41, 42 and 43 described above, but is not limited thereto. The nozzle unit 100 may be the second or the third injection unit.

The nozzle unit 100 is provided to receive wash water from the supply pipe 50 and inject the wash water into the washing tub 12. The nozzle unit 100 may be rotatably provided. In detail, the nozzle unit 100 may be rotatably provided by the rotational force of the water pressure of the washing water discharged into an injection hole 114 formed in the nozzle unit 100.

The nozzle unit 100 may include a unit body 110 and a rotation holder 180. The rotation holder 180 is rotatably disposed on the supply pipe 50 and is provided to be coupled to the unit body 110. In detail, the supply pipe 50 includes a connection portion 170 configured to allow the nozzle unit 100 to be rotatably coupled. The rotation holder 180 is rotatably provided at the connection portion 170. The unit body 110 is provided to rotate relative to the supply pipe by rotation of the rotation holder 180.

The unit body 110 is rotatably connected to the supply pipe 50 together with the rotation holder 180. At least one injection hole 114 is provided in the unit body 110 and the washing water supplied from the supply pipe is injected into the washing space 12*a* through the at least one injection hole 114.

The supply pipe 50 may include a connection portion 170.

The connection portion 170 may be provided at an end of the supply pipe 50 so that the nozzle unit 100 is rotatably coupled. The connection portion 170 may be formed separately from the supply pipe 50 and may be coupled to the supply pipe 50 or may be formed integrally with the supply pipe 50.

The connection portion 170 may include a connection pipe 172 extending from the supply pipe 50. An inner pipe of the connection pipe 172 is connected to an inner pipe of the supply pipe 50 and the washing water is supplied to the inside of the unit body 110 from the supply pipe 50 through the connection pipe 172.

The connection portion 170 may include a holder 178. The connection portion 170 may further include a support portion 176. The holder 178 and the support portion 176 are provided on the connection pipe 172 to restrict movement of the rotation holder 180.

The holder 178 is configured to prevent the rotation holder 180 from detaching from the connection pipe 172. The shape of the holder 178 is not limited, but may be provided to have a ring shape as an example. The holder 178 may be detachably provided from the connection pipe 172. The annular holder 178 may be fitted to the end of the connection pipe 172. The inner diameter of the holder 178 may be smaller than the outer diameter of the connection pipe 172. The holder 178 may be fitted to the connection pipe 172 by fitting the outer surface of the connection pipe 172 through the elastic deformation.

The holder 178 is configured to have an outer diameter larger than the outer diameter of the connection pipe 172, and a seating projection 179 may be formed on the inner surface thereof. The seating projection 179 may be formed long in the circumferential direction on the inner circumferential surface of the holder 178, or may be formed in at least a part of the circumferential direction. The connection pipe 172 is formed to be concave along its periphery and a seating groove 174 may be formed so that the seating projection 179 can be inserted. In this embodiment, the seating groove 174 may be formed in an annular shape along the circumference of the connection pipe 172. The seating projection 179 may also be formed in an annular shape along the inner circumferential surface of the holder 178, corresponding to the seating groove 174 of the annular shape.

As described above, the holder 178 may be provided separately with the seating projection 179, but the curved inner surface of the annular holder 178 may be coupled to the coupling groove 125 by being seated.

In the above description, the holder 178 is coupled to the connection pipe 172. However, the present disclosure is not limited thereto. The holder 178 may be coupled to the connection pipe 172. The rotation holder 180 may not be detached from the connection pipe 172 by the holder 178 having an outer diameter larger than the outer diameter of the connection pipe 172.

The holder 178 may include a material having a coefficient of friction that is smaller than the connection pipe 172.

The rotation holder 180 is brought into close contact with the holder 178 by the gravity due to the weight of the rotation holder 180 and the unit body 110 because the rotation holder 180 is coupled with the unit body 110. Further, abrasion due to friction due to rotation of the rotation holder 180 may occur between the rotation holder 180 and the holder 178.

Therefore, the holder 178 may be configured to include a material having a smaller coefficient of friction than the connection pipe 172, so that the friction force between the rotation holder 180 can be small. Also, since the holder 178 can be detachably provided from the connection pipe 172, when the holder 178 is worn, the holder 178 can be easily separated, replaced or repaired.

The support portion 176 is provided on the connection pipe 172 and may be spaced apart from the holder 178 by a predetermined distance. That is, a mounting space 161 in which the rotation holder 180 is rotatably disposed may be formed between the support portion 176 and the holder 178. The support portion 176 and the holder 178 may be spaced apart from each other by a predetermined distance. The support portion 176 may be formed in the shape of a flange along the periphery of the connection pipe 172 and may be formed to have an outer diameter larger than the connection pipe 172. The support portion 176 forms the upper limit of movement of the rotation holder 180 and the holder 178 may define the lower limit of movement of the rotation holder 180.

Figure 5:
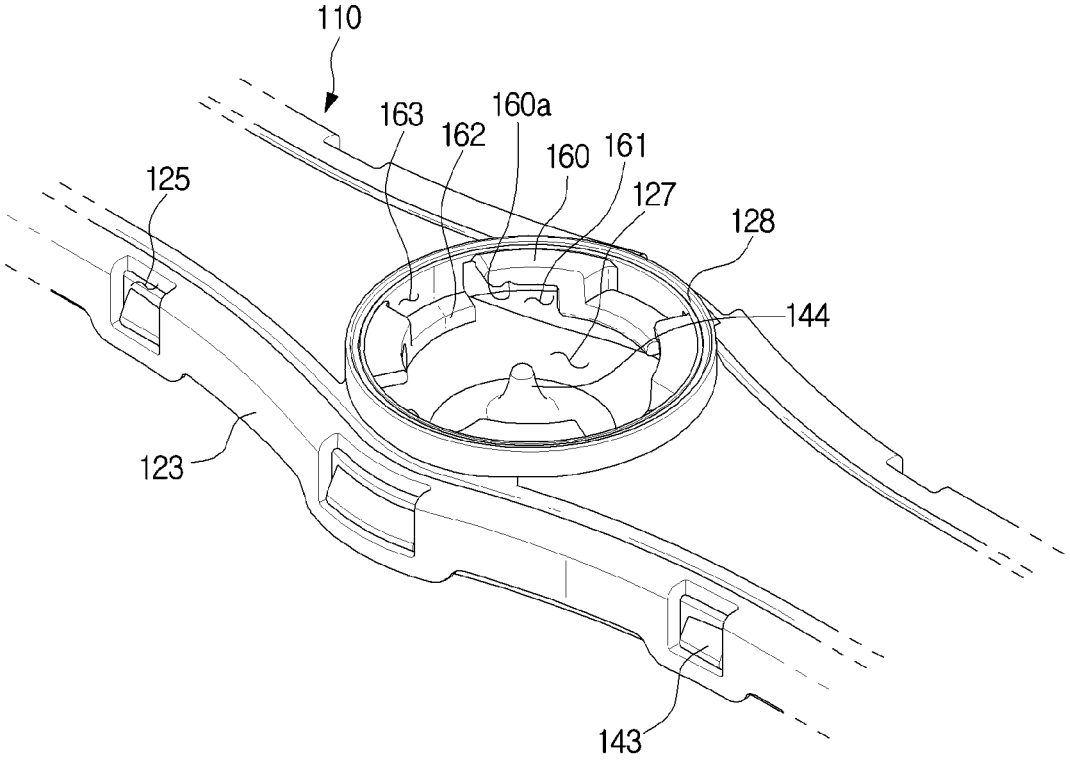
FIG. 5 is an enlarged view of a part of a unit body of the dishwasher according to an embodiment of the present disclosure.
Figure 6:
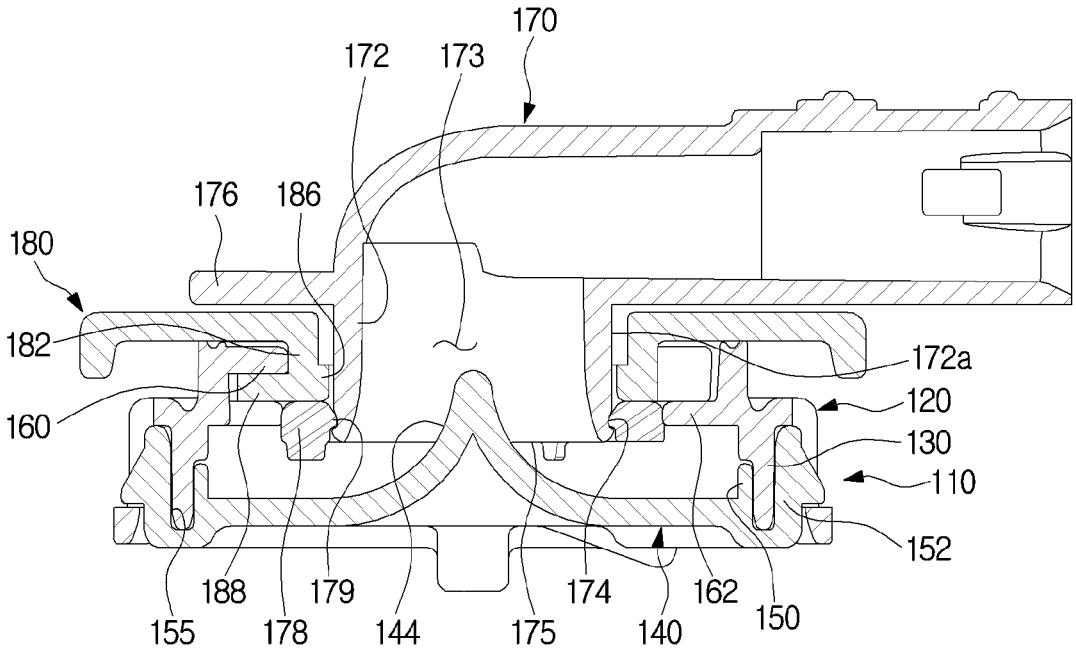
FIG. 6 is a sectional view of the unit body of the dishwasher according to an embodiment of the present disclosure

FIG. 5 is an enlarged view of a part of the unit body of the dishwasher according to an embodiment of the present disclosure. FIG. 6 is a sectional view of the unit body of the dishwasher according to an embodiment of the present disclosure. This will be described with reference to FIGS. 3 and 4.

The rotation holder 180 is rotatably disposed on a supply pipe as described above and is provided to be coupled to the unit body 110.

The rotation holder 180 may include a rotation holder body 182 and a mounting projection 188.

The rotation holder body 182 is provided to be mountable outside the connection pipe 172. That is, a mounting hole 184 (see FIG. 3) in which the connection pipe 172 is inserted is formed inside the rotation holder body 182. For this, the rotation holder body 182 is provided to have an inner diameter larger than the outer diameter of the connection pipe 172.

The rotation holder 180 may further include a holder support portion 190 provided at one end of the rotation holder body 182. The holder support portion 190 is provided to have a flange shape so as to have an outer diameter larger than the rotation holder body 182. The holder support portion 190 is disposed between the support portion 176 of the connection portion 170 and the unit body 110 so that the rotation holder 180 can be stably mounted.

The rotation holder 180 may include a spaced projection 186 formed along the inner circumferential surface of the rotation holder body 182. The spaced projection 186 is provided to reduce the contact area between the rotation pipe holder body 182 and the connection pipe 172 inserted into the mounting hole 184 of the rotation holder body 182. At least one spaced projection 186 may be provided along the inner circumferential surface of the rotation holder body 182. In this embodiment, a plurality of spaced projections 186 may be provided to be spaced from each other along the circumferential direction. The plurality of spaced projections 186 extends along the longitudinal direction of the rotation holder body 182 and may be spaced apart from one another along the circumferential direction.

The mounting projection 188 is provided along the periphery of the rotation holder body 182 and is configured to fit into the unit body 110. At least one mounting projection 188 may be provided, and a plurality of mounting projections 188 spaced from each other may be provided according to the embodiment.

The mounting projection 188 may be fitted into a plurality of ribs of the unit body 110 described below. The rotation projection 180 and the unit body 110 can be selectively coupled to each other by engaging or disengaging the mounting projection 188 with a plurality of ribs. The mounting projection 188 may be spaced apart from the holder support portion 190 by a certain distance. A mounting rib 160 of the unit body 110, which will be described later, may be inserted between the mounting projection 188 and the holder support portion 190. Therefore, the distance between the mounting projection 188 and the holder support portion 190 can be equal to or greater than the thickness of the mounting ribs 160.

A fixing projection 189 may be provided on one side of the mounting projection 188. The fixing projection 189 is formed to protrude from the mounting projection 188. The fixing projection 189 protrudes from the upper surface of the mounting projection 188. A fixing groove 160*a* (see FIG. 4) may be formed on the lower surface of the mounting rib 160 so that the fixing projection 189 can be inserted thereinto.

The rotation holder 180 may include a handle 192. The handle 192 is provided on the rotation holder 180 so that the user can grip the rotation holder 180. The rotation holder 180 and the unit body 110 can be easily coupled through the operation of the handle 192.

The handle 192 may be formed in the holder support portion 190 and may be formed to protrude from the holder support portion 190. In this embodiment, a pair of handles 192 is provided at both ends of the holder support portion 190.

The unit body 110 may include a plurality of ribs.

The plurality of ribs are provided to allow the mounting projection 188 to be fitted and the unit body 110 is coupled to the rotation holder 180 as the mounting projection 188 is inserted into the plurality of ribs.

The plurality of ribs may be formed in an opening forming portion 128 forming an opening 127 of the unit body 110. The opening 127 of the unit body 110 may be configured to allow the wash water flowing from the supply pipe 50 to flow. That is, the opening 127 of the unit body 110 may be configured to be connected to an inner path 173 of the connection portion 170. The plurality of ribs may be formed along the opening forming portion 128. In detail, the plurality of ribs may be formed to protrude from the opening forming portion 128. The mounting projection 188 of the rotation holder 180 is mounted on the plurality of ribs so that the inner path of the connection pipe 172 is connected to the opening 127 of the unit body 110.

The plurality of ribs may include a mounting rib 160.

The mounting ribs 160 are provided to restrict movement of the mounting projection 188 to prevent the unit body 110 from disengaging from the rotation holder 180. The mounting ribs 160 may form a mounting space 161 where the mounting projections 188 are located. The mounting projection 188 is provided in the mounting space 161 formed at the lower portion of the mounting rib 160 when the unit body 110 is mounted on the rotation holder 180. With this configuration, it is possible to prevent the unit body 110 from being separated from the rotation holder 180. The plurality of mounting ribs 160 may be provided corresponding to the plurality of mounting projections 188.

A fixing groove 160*a* may be formed on one side of the mounting rib 160. In detail, the fixing groove 160*a* is formed concavely on the lower surface of the mounting rib 160. The fixing groove 160*a* is provided to allow the fixing projection 189 of the mounting projection 188 to be inserted therein. The mounting projection 188 is located in the mounting space 161 formed by the mounting rib 160 and the fixing projection 189 is inserted into the fixing groove 160*a*, thereby preventing the mounting projection 188 from deviating in a circumferential direction.

The plurality of ribs may include a support rib 162 and a connection rib 164.

The support ribs 162 may form an insertion space 163 into which the mounting projection 188 is inserted. A plurality of support ribs 162 may be provided corresponding to the plurality of mounting projections 188. The plurality of support ribs 162 and the plurality of mounting ribs 160 may be spaced apart in the direction of the rotation axis of the unit body 110 and alternately arranged along the circumferential direction.

The plurality of connection ribs 164 may be provided to connect the plurality of support ribs 162 and the plurality of mounting ribs 160. A space is provided between one end of the plurality of mounting ribs 160 and the other end of the plurality of support ribs 162 so that the mounting projection 188 is allowed to be moved therein. A plurality of connection ribs 164 are connected between the other end of the plurality of mounting ribs 160 and one end of the plurality of support ribs 162. That is, the mounting ribs 160, the connection ribs 164, and the support ribs 162 are connected to each other and are formed in the circumferential direction, so that the opening 127 can be minimized. The mounting projection 188 is disposed between the plurality of ribs and the rotation holder body 182 is disposed in a circumferential direction of the plurality of ribs to reduce a gap between the rotation holder 180 and the unit body 110. Thus, leakage between the unit body 110 and the connection pipe 172 can be reduced.

The connection rib 164 may serve as a stopper. The mounting projection 188 moves from the insertion space 163 to one side of the mounting rib 160 so that the rotation holder 180 and the unit body 110 are engaged with each other. The mounting projection 188 may serve as a stopper to limit the movement of the mounting projection 188 relative to the mounting direction so that the mounting projection 188 does not leave the mounting space 161 formed by the mounting rib 160. The connection rib 164 may also be referred to as a stopper.

The unit body 110 may include an inlet guide portion 144.

The inlet guide portion 144 is protruded from the lower inner surface 141 of the lower body 140 and is provided to distribute the wash water supplied through the supply pipe to the inner space 112 of the unit body 110. The inlet guide portion 144 is provided so that the washing water flowing into the unit body 110 is uniformly dispersed. The inlet guide portion 144 may have a conical shape, and the side surface thereof may have a predetermined radius of curvature. The inlet guide portion 144 distributes the washing water flowing into the unit body 110 to the inner space 112 so that the center of the inlet guide portion 144 coincides with the center of a supply port 175 formed at the end of the connection pipe 170.

The inlet guide portion 144 protrudes from the lower body 140 and can be inserted into the supply port 175. That is, at least a portion of the inlet guide portion 144 may be inserted into the connection pipe. With this configuration, the wash water supplied to the supply pipe 50 can be stably guided and dispersed into the unit body 110.

The unit body 110 may include the plurality of coupling ribs. The plurality of coupling ribs may be formed along at least a portion of the unit body 110. In the present embodiment, the plurality of coupling ribs are formed in a portion of the unit body 110 except for at least one injection hole 114. Whereby the unit body 110 may be coupled or the inside of the unit body 110 may be closed.

The lower body 140 may include first and second coupling ribs 150 and 152. The first coupling ribs 150 are formed along the periphery of at least a portion of the lower body 140 and the second coupling ribs 152 are spaced apart from the first coupling ribs 150 in the outward direction. The first and second coupling ribs 150 and 152 are configured to protrude upward from the lower body 140. The first and second coupling ribs 150 and 152 can form an insertion groove 155 so that a third coupling rib 130 described later can be inserted as a spacing space therebetween.

The upper body 120 may include the third coupling rib 130. The third coupling rib 130 is formed along the periphery of at least a portion of the upper body 120 and may be inserted between the first and second coupling ribs described above. That is, the third coupling rib 130 may be inserted into the insertion groove 155 formed by the first and second coupling ribs. The first to third coupling ribs are arranged alternately so that the inner space 112 can be sealed in a superimposed manner.

In the unit body 110, the lower body 140, the inlet guide portion 144, and the third coupling rib 130 may be integrally formed. That is, the lower body 140, the inlet guide portion 144, and the third coupling rib 130 are integrally formed to seal the lower portion of the unit body 110. That is, the washing water flowing through the opening 127 formed in the upper body 120 is distributed to the inner space 112 by the inlet guide 144. In this process, the inlet guide portion 144, the third coupling rib 130, and the lower body 140 are integrally formed with the bottom of the unit body 110 as a closed structure, and thus it is possible to prevent the washing water from leaking.

Hereinafter, a dishwasher according to another embodiment of the present disclosure will be described.

Figure 7:
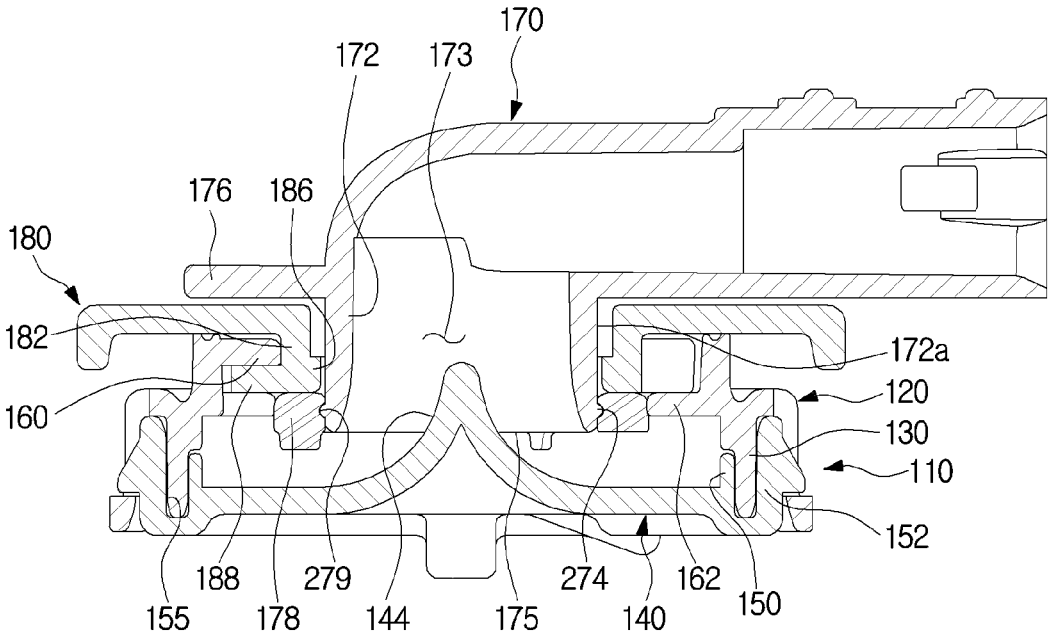
FIG. 7 is a sectional view of a unit body of a dishwasher according to another embodiment of the present disclosure.

FIG. 7 is a sectional view of a unit body of a dishwasher according to another embodiment of the present disclosure.

A connection portion 170 may include a holder 178. The connection portion 170 may further include a support portion 176. The holder 178 and the support portion 176 are provided on a connection pipe 172 to restrict movement of a rotation holder 180.

The holder 178 is configured to prevent the rotation holder 180 from detaching from the connection pipe 172. The shape of the holder 178 is not limited, but may be provided to have a ring shape as an example. The holder 178 may be detachably provided from the connection pipe 172. The annular holder 178 can be fitted to the end of the connection pipe 172. The inner diameter of the holder 178 may be smaller than the outer diameter of the connection pipe 172. The holder 178 can be fitted to the connection pipe 172 by fitting the outer surface of the connection pipe 172 through the elastic deformation.

The holder 178 is configured to have an outer diameter larger than the outer diameter of the connection pipe 172, and a seating groove 274 may be formed on the inner surface thereof. The seating groove 274 may be formed long in the circumferential direction on the inner circumferential surface of the holder 178, or may be formed in at least a part of the circumferential direction. The connection pipe 172 is formed to be convex along its circumference, and a seating projection 279 can be formed to be inserted into a fixing groove. In this embodiment, the seating projection 279 is annular along the circumference of the connection pipe 172 and the seating groove 274 corresponds to the seating projection 279 in the annular shape, As is apparent from the above description, according to the proposed dishwasher, a nozzle unit can be easily detached from a supply pipe supplied with cleaning water by improving the mounting structure of the nozzle unit.

Also, by improving the mounting structure of the nozzle unit and decreasing the flow loss, the injection efficiency of the washing water sprayed through the nozzle unit can be improved.

The present disclosure has been described in detail with reference to the exemplary embodiments. However, the exemplary embodiments should be considered in a descriptive sense only, and the disclosure is not limited thereto. It will be apparent to those skilled in the art that various modifications and improvements within the scope of the disclosure may be made.

What is claimed is:

1. A dishwasher comprising:

a cabinet including a washing compartment provided at an inside of the cabinet;

a supply pipe configured to transfer water to the washing compartment; and a nozzle assembly connected to the supply pipe and configured to spray the water from the supply pipe into the washing compartment, wherein the nozzle assembly comprises:

an assembly body having an injection hole configured to spray the water into the washing compartment; and a rotation holder coupled to the assembly body and rotatably disposed on an outer circumference of the supply pipe, and wherein the supply pipe comprises:

a holder configured to be detachably coupled to the outer circumference of the supply pipe to support a rotation of the rotation holder relative to the supply pipe and the holder.

2. The dishwasher of claim 1, wherein the holder is provided in a ring shape and is fitted to an end of the supply pipe.

3. The dishwasher of claim 1, wherein the supply pipe includes:

an annular seating groove formed along a circumference of the supply pipe, and wherein the holder includes:

a seating projection having an outer diameter larger than that of the supply pipe, and configured to be inserted into the annular seating groove.

4. The dishwasher of claim 1, wherein the supply pipe includes:

an annular seating protrusion formed along a circumference of the supply pipe, and wherein the holder includes:

a seating groove having an outer diameter larger than that of the supply pipe, and having an inner surface on which the seating protrusion is inserted.

5. The dishwasher of claim 1, wherein the holder includes a material having a coefficient of friction smaller than that of the supply pipe.

6. The dishwasher of claim 1, wherein the supply pipe further includes:

a support portion formed along a periphery of the supply pipe and spaced apart from the holder to form a mounting space in which the rotation holder is disposed between the holder and the support pipe.

7. The dishwasher of claim 1, wherein the rotation holder includes:

a rotation holder body rotatably disposed outside the supply pipe; and a mounting projection protruding from an outer circumferential surface of the rotation holder body, wherein the assembly body includes:

an opening forming portion forming an opening through which the water supplied from the supply pipe flows; and a plurality of ribs protruding from the opening forming portion and fitted with the mounting projection so that the assembly body is mounted on the rotation holder.

8. The dishwasher of claim 7, wherein the plurality of ribs includes mounting ribs supporting the mounting projection and restricting movement of the mounting projection.

9. The dishwasher of claim 8, wherein the plurality of ribs includes:

a plurality of support ribs forming an insertion space into which the mounting projection is inserted; and a plurality of connection ribs connecting the plurality of support ribs and the plurality of mounting ribs.

10. The dishwasher of claim 9, wherein the plurality of mounting ribs and the plurality of support ribs are alternately arranged in a circumferential direction while being spaced apart in a rotation axis direction of the rotation holder.

11. The dishwasher of claim 9, wherein one end of the plurality of mounting ribs and an other end of the plurality of support ribs are separated from each other to allow the mounting projections to moved, and wherein the plurality of connection ribs connect an other end of the plurality of mounting ribs and one end of the plurality of support ribs.

12. The dishwasher of claim 1, wherein the rotation holder further includes:

at least one spaced projection provided on an inner circumferential surface of the rotation holder body and configured to protrude to be separated from the supply pipe.

13. The dishwasher of claim 1, wherein the assembly body includes:

an inlet guide portion protruding from the inside of the assembly body, and having at least a portion inserted into an end portion of the supply pipe.

14. The dishwasher of claim 13, wherein the assembly body includes:

an upper body having a first coupling rib and a second coupling rib forming an insertion groove between the first coupling rib and the second coupling rib and disposed outside the first coupling rib; and a lower body having a third coupling rib inserted into the insertion groove and forming an inner space between the upper body and the lower body, and wherein the lower body, the inlet guide portion, and the third coupling rib are integrally formed.

15. A dishwasher comprising:

a cabinet including a washing compartment provided at an inside of the cabinet;

a supply pipe including a connection portion and configured to transfer water to the washing compartment; and a nozzle assembly connected to the connection portion and configured to spray the water from the supply pipe into the washing compartment, wherein the nozzle assembly comprises:

an assembly body having an opening forming portion forming an opening, having an inner circumference larger than an outer circumference of an end of the supply pipe, through which the water from the supply pipe flows and a plurality of ribs formed at the opening forming portion and having an inner circumference larger than the outer circumference of an end of the supply pipe; and a rotation holder having a mounting projection configured to be mountable to the plurality of ribs and rotatable about the connection portion.

16. The dishwasher of claim 15, wherein the plurality of ribs includes:

a plurality of mounting ribs to which the mounting projection is mounted and restricting movement of the mounting projection.

17. The dishwasher of claim 16, wherein the plurality of ribs includes:

a plurality of support ribs forming an inserting space for inserting the mounting projection and spaced apart from each other in a rotation axis direction of the rotation holder and arranged alternately in a circumferential direction with the plurality of mounting ribs; and a plurality of connection ribs connecting the plurality of support ribs and the plurality of mounting ribs.

18. The dishwasher of claim 17, wherein one end of the plurality of mounting ribs and an other end of the plurality of support ribs are spaced apart from each other, and wherein the plurality of connection ribs connects an other end of the plurality of mounting ribs and one end of the plurality of support ribs.

19. The dishwasher of claim 15, wherein the rotation holder includes:

a rotation holder body formed with the mounting projection and positioned between an inner end of the plurality of ribs and the supply pipe.

20. A dishwasher comprising:

a cabinet including a washing compartment;

a supply pipe including a connection portion and configured to supply water to the washing compartment; and a nozzle assembly rotatably connected to the connection portion and configured to spray the water into the washing compartment, wherein the connection portion comprises:

a holder having an inner diameter larger than an outer diameter of the supply pipe and fitted to an outer circumference of an end of the supply pipe, wherein the nozzle assembly comprises:

a rotation holder rotatably disposed on the supply pipe, and configured to be restricted in movement in a rotation axis direction by the holder; and an assembly body having an injection hole configured to spray the water into the washing compartment, and detachably coupled to the rotation holder to rotate together with the rotation holder.

* * * * *